United States Patent [19]

Wilson

[11] Patent Number: 4,598,440

[45] Date of Patent: Jul. 8, 1986

[54] HIGH SPEED FLOOR BUFFING MACHINE AND FLOOR BUFFING METHOD

[75] Inventor: William H. Wilson, Sparta, N.C.

[73] Assignee: Pioneer/Eclipse Corporation, Sparta, N.C.

[21] Appl. No.: 632,235

[22] Filed: Jul. 19, 1984

[51] Int. Cl.[4] ..... A47L 11/14; A47L 13/16

[52] U.S. Cl. ..... 15/385; 15/98; 15/230.16; 15/230.18; 15/410

[58] Field of Search ..... 15/98, 230.16, 230.18, 15/385, 49 R, 410

[56] References Cited

U.S. PATENT DOCUMENTS

| | | | |
|---|---|---|---|
| 935,558 | 9/1909 | Spangler | 15/385 X |
| 1,093,820 | 4/1914 | Beach | 15/385 X |
| 1,763,365 | 6/1930 | Nobbs | 15/385 X |
| 1,857,240 | 5/1932 | Dittmar | 15/98 X |
| 2,415,372 | 2/1947 | Salt et al. | 15/385 |
| 2,668,976 | 2/1954 | Beach | 15/230.16 |
| 2,949,619 | 8/1960 | Holt | 15/49 R |
| 3,619,849 | 11/1971 | Jones | 15/322 X |
| 3,678,532 | 7/1972 | Boyd | 15/236 C |
| 4,178,654 | 12/1979 | Mitchell | 15/385 |
| 4,307,480 | 12/1981 | Fallen | 15/230.18 |
| 4,322,866 | 4/1982 | Brazzale | 15/98 X |
| 4,358,868 | 11/1982 | Cook | 15/49 R |

*Primary Examiner*—Chris K. Moore

*Attorney, Agent, or Firm*—Wigman & Cohen

[57] ABSTRACT

The disclosure relates to an electric buffing machine which is equipped with an X-shaped buffing pad that is mounted to a similarly X-shaped pad holder. The arms of the pad holder have a wedge-shaped cross section that acts as an air foil to create air currents that flow up between the arms of the X-pad. The casing surrounding the pad has a specially designed tunnel-like spiral diffuser that guides the air currents entered into a collection box. The casing also has a flexible skirt mounted to the lower side thereof, extending around three-quarters of the casing periphery, which closes the gap between the casing and the floor. The chassis has two pairs of wheels and is designed so that when the buffing machine is turned off, the machine rests entirely on the wheels with the buffing pad raised off the ground. When the machine is turned on, the air currents pull the pad to the floor with a predetermined pressure.

25 Claims, 10 Drawing Figures

FIG. 9
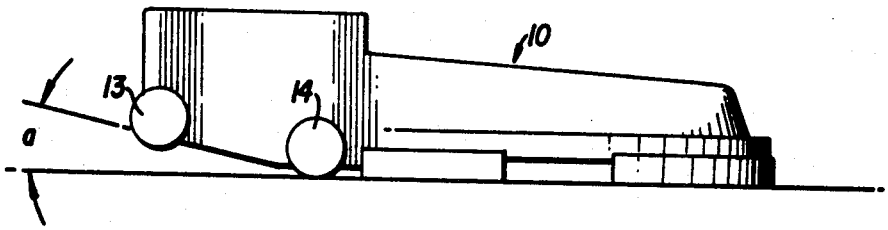
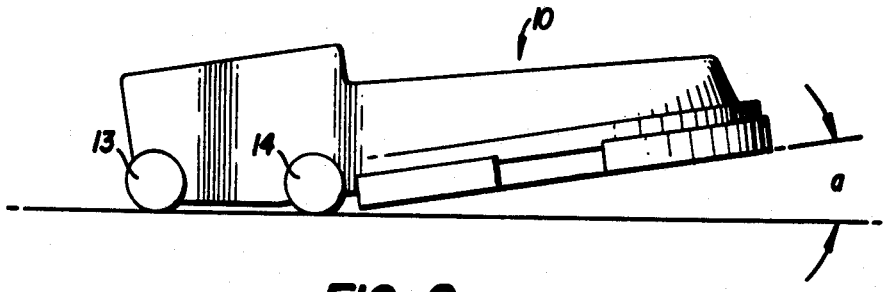
FIG. 8

HIGH SPEED FLOOR BUFFING MACHINE AND FLOOR BUFFING METHOD

BACKGROUND OF THE INVENTION

The present invention relates to floor buffing machines and methods, and more particularly to a unique, high speed floor buffing machine utilizing a specially designed casing and buffing pad and an aerodynamically designed pad holder to reduce motor load and control dust and debris.

A search of the prior art failed to uncover any prior art references which disclose the high speed buffing machine or method of the present invention. The following patents were uncovered which disclose buffing machines or similar rotary equipment of varying design and complexity: U.S. Pat. Nos. 548,201; 3,417,420; 3,619,954; 3,974,598; 4,148,110; 4,358,868; and 4,365,377.

U.S. Pat. Nos. 548,201; 3,417,420; and 3,619,954 disclose a sweeping brush, buffing pad and sanding disc, respectively, having a generally X-shaped configuration. However, because of the material or design, none of those buffing pad devices are suitable for high speed floor buffing.

U.S. Pat. Nos. 3,974,598 and 4,148,110 each disclose rotary scraping or sanding tools having air foil blades mounted on the rotary discs for expelling dust and debris from a workpiece. Those devices are also not suitable for buffing, particularly for floor buffing, because they are too small and are suitable only for scraping or sanding.

Conventional floor buffing equipment utilizes flat, circular buffing pads, which, when powered by an electric motor, revolve at speeds usually between about 175 and 1000 RPM, although some operate at speeds as high at 2000 RPM. For a standard electric motor to operate a conventional buffing pad at the high range of rotational speed, only a slight pressure can be exerted upon the floor by the pad without straining the motor or causing the motor to draw excessive current.

In order to obtain a superior finish on a waxed floor when dry buffing, i.e., buffing a previously waxed floor without adding new wax, it is necessary to generate enough friction and heat to actually melt the top layer of wax on the floor. The amount of friction and the resulting heat generated is proportional to the rotary speed at which the buffing pad operates and the pressure the pad exerts on the floor.

However, the load and resulting power draw of an electric buffing machine motor depends, not only on the combination of the speed at which the pad rotates and the pressure exerted on the floor by the pad, but also on the area of contact between the buffing pad and the floor, i.e., the size of the buffing pad. Since the power draw of a conventional electric buffing machine motor is limited to what can reasonably be supplied from a 110-volt wall outlet, there is a finite limit to the size or area of a buffing pad that can generate sufficient friction and heat to actually melt the top layer of wax. With state-of-the-art electric motors, only a small area pad of conventional, i.e., circular, design can achieve a superior finish. Since a small area pad would result in a prohibitively long time to buff a large floor, conventional electric floor buffing machines are not designed to operate at speeds and pressures high enough to achieve a superior finish on waxed floors. In essence, quality of finish is generally sacrificed for speed.

A further problem with the conventional circular buffing pads is that they generate a significant amount of air currents and loose debris. Unfortunately, the air currents are not well directed and usually blow the loose debris away from the buffing machine to generally inaccessible areas, such as underneath shelving and tables where it is difficult to collect.

OBJECTS AND SUMMARY OF THE INVENTION

In view of the foregoing limitations and shortcomings of the prior art devices, as well as other disadvantages not specifically mentioned above, it should be apparent that there exists a need in the art for a floor buffing machine that is capable of buffing large floor surface areas efficiently with a superior finish. It is also apparent that there is a need in the art for a floor buffing machine that is designed to collect the loose debris generated by the buffing operation, rather than to expel it from the machine.

It is, therefore, a primary object of this invention to fulfill that need by providing a floor buffing machine that is capable of buffing large floor surface areas efficiently and with sufficient friction to achieve a high quality finish on the wax being buffed.

Another object of the present invention to provide a buffing pad of a unique design that permits an electric buffing machine to develop adequate friction between the pad and floor over an adequate surface area without straining the motor or causing the motor to draw excessive current.

It is another object of the present invention to provide a buffing pad and buffing pad holder that create a vacuum effect for collecting loose dirt.

It is yet another object of the present invention to provide a buffing machine that is designed such that the pad pressure on the floor is automatically controlled by suction created by the pad holder.

Yet another object of the present invention to provide a buffing machine that collects the loose debris created by the buffing process by means of controlled air currents generated by the machine.

Still another object of the present invention to provide a casing for a buffing machine that is designed to direct air currents in such a manner that loose debris is collected and guided into a collection box.

It is still a further object of the present invention to provide a buffing machine that is designed such that proper buffing pressure is always exerted by the pad on the floor to be buffed.

Briefly described, the aforementioned objects are accomplished according to the invention by providing a buffing machine, preferably electric, which is equipped with an X-shaped buffing pad having a diameter similar to a conventional circular buffing pad, but with much less surface area than the conventional pad. Because of the reduced surface area, the X-shaped pad can be rotated at higher speeds than conventional pads. The pad holder is similarly X-shaped and has four arms with a wedge-shaped cross section that functions as an air foil to create air currents that flow upwardly between the arms of the X-shaped pad and pad holder.

The casing surrounding the pad has a depending flexible skirt mounted to the lower edge thereof which extends around all but a small portion of the casing periphery and which closes the gap between the casing and the floor. The X-shaped pad, pad holder and skirting cause the air currents to collect loose dirt and direct it into a specially designed tunnel-like region in the casing that guides the air currents and dirt into a collection box. A handle is mounted to the casing in a pivotable manner so that the operator is prevented from exerting excess pressure on the pad.

The machine has two sets of wheels, one located at the rear of the machine and the other located in an intermediate position directly behind the buffing pad. When the machine is off, it is balanced so that the machine rests on all four wheels, with the buffing pad raised above the floor and inclined at a slight angle. When the machine is turned on, the vacuum effect created by the pad holder pulls the buffing pad onto the floor with a predetermined force. In that position, the weight of the machine is distributed between the buffing pad and the set of wheels located directly behind the pad. The rear wheels are positioned above the floor.

With the foregoing and other objects, advantages and features of the invention that will become hereinafter apparent, the nature of the invention may be more clearly understood by reference to the following detailed description of the invention, the appended claims and to the several views illustrated in the attached drawings.

BRIEF DESCRIPTION OF THE DRAWINGS

FIG. 8 is a side elevation view of the machine in the "off" position; and

FIG. 9 is a side elevation view of the machine in the "on" position.

DETAILED DESCRIPTION OF THE PREFERRED EMBODIMENT

Figure 1:
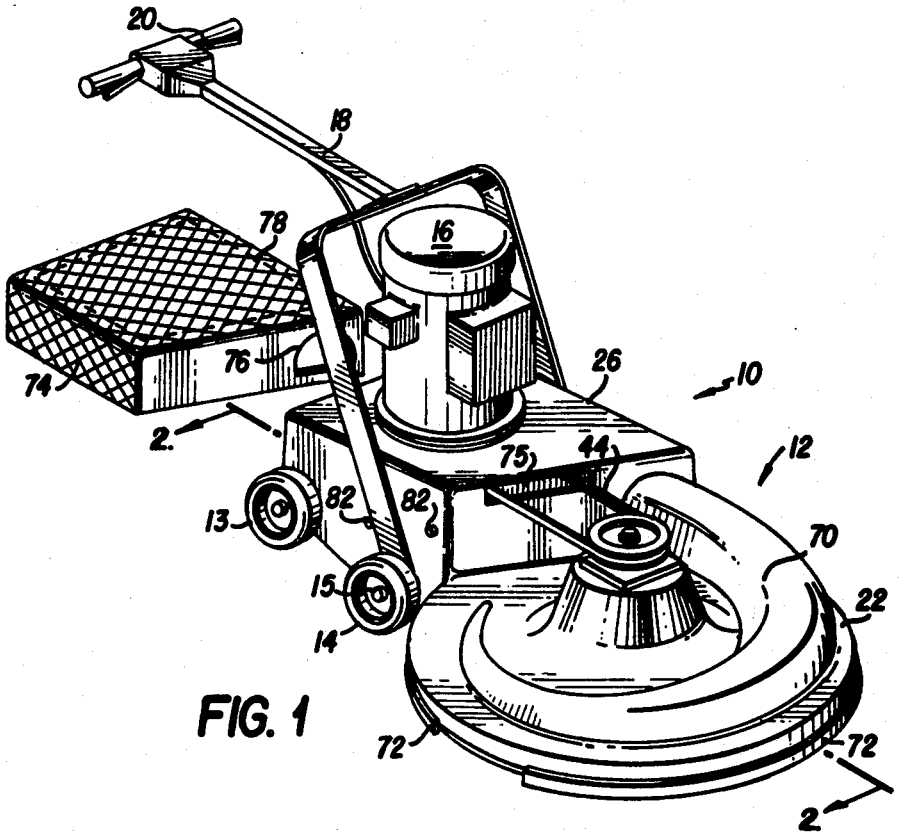
FIG. 1 is a perspective view of an electric buffing machine according to the present invention.
Figure 2:
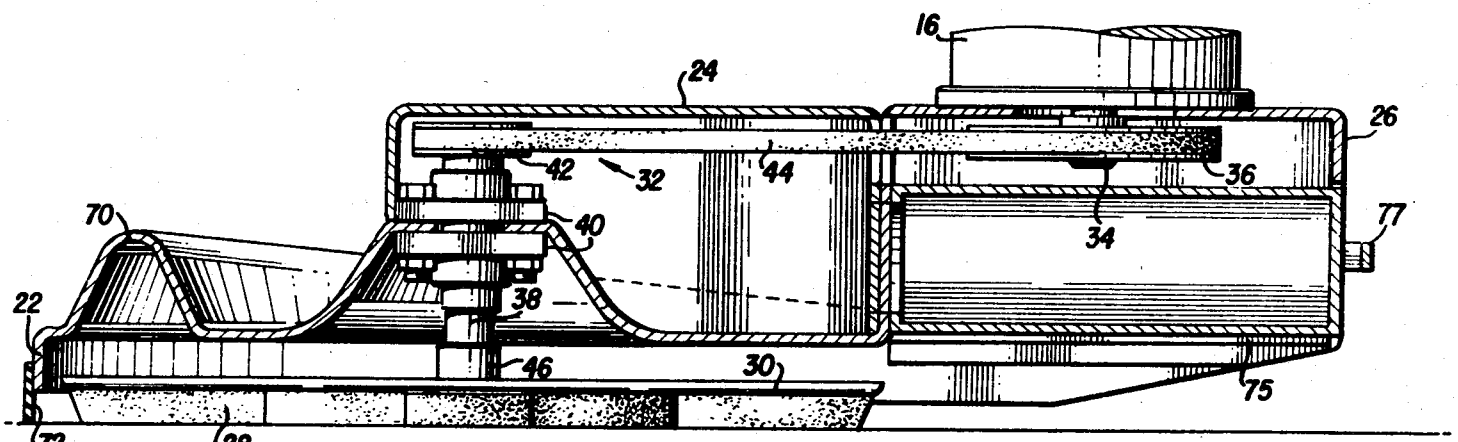
FIG. 2 is a side elevation view of the buffing pad and transmission, partly in section, taken along line 2—2 of FIG. 1.
Figure 3B:
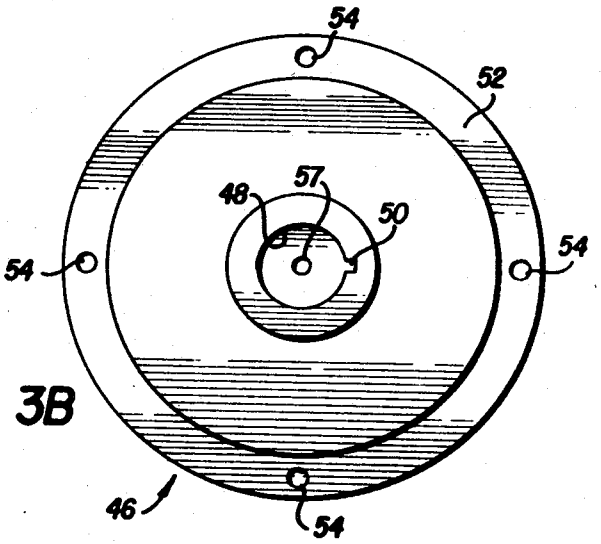
FIG. 3B is a top plan view of the hub arrangement for the pad holder of the buffing machine of the present invention.
Figure 3A:
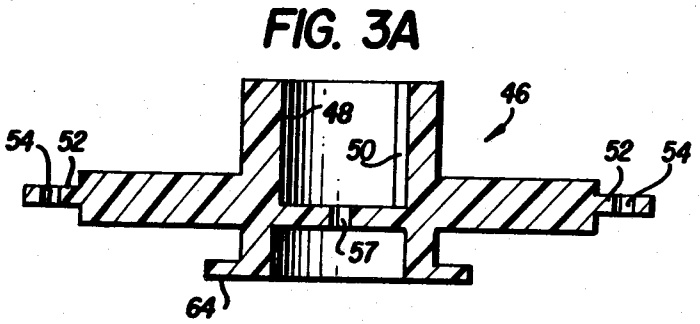
FIG. 3A is a side elevation view in cross-section of the hub arrangement for the pad holder of the buffing machine of the invention.
Figure 7:
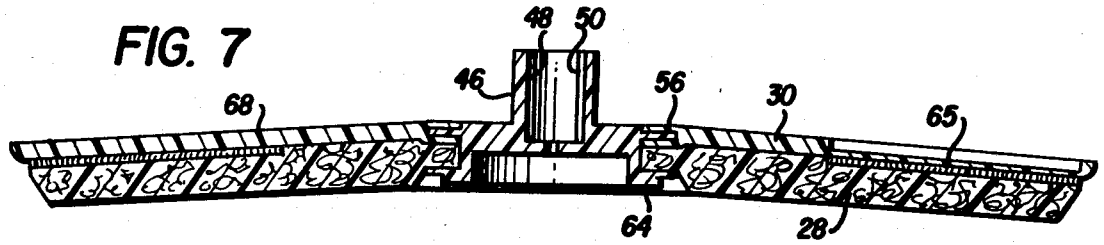
FIG. 7 is a side elevation view of the pad holder taken along line 7—7 of FIG. 5.

Referring now in detail to the drawings, there is shown in FIG. 1 a perspective view of a floor buffing machine 10 according to the present invention. As seen in FIG. 1, the buffing machine 10 includes a chassis 12, two pairs of wheels 13, 14, an electric motor 16, and a handle 18 with electric motor controls 20. The chassis 12 comprises two separate sections, the pad housing or casing 22, and the motor housing 26. A belt cover 24 fits over the pad casing 22 and is partially shown in FIG. 2. Enclosed within the chassis 12 are a buffing pad 28, a pad holder 30, and a transmission means 32 for driving the buffing pad 28, which components can be more clearly seen in FIGS. 2–7.

The transmission means 32 includes a drive shaft 34 extending from the motor 16 into the motor housing 26 of the chassis 12. A drive pulley 36 is fixedly mounted to the drive shaft 34. Arranged parallel to the drive shaft 34 is a driven shaft 38 rotatably mounted to the casing 22 by bearings 40. A pulley 42 is rigidly mounted to the driven shaft 38 above the pad casing 22 of the chassis 12 and is connected to the drive pulley 36 by a drive belt 44, such as a conventional V-belt.

At the lower end of the driven shaft 38, below the chassis bearings 40, there is mounted a hub 46. The hub 46 has an inner bore 48, into which the shaft 38 fits. A key (not shown) from shaft 38 fits into a keyway 50 within the bore, and rotationally secures the shaft to the hub. A bolt (not shown) extends through an opening 58 in the hub and engages in a threaded bore (not shown) within the shaft 38 to further secure the shaft 38 to the hub 46.

The pad holder 30 is manufactured in a dual molding process. The hub 46 is a one piece unit that comprises the shaft engaging bore 48, a flanged support 64 that is used to secure the buffing pad 28 onto the pad holder 30, and a mounting flange 52 extending radially from the bore 48. The mounting flange 52 has small holes 54 extending through it adjacent its outer periphery, for facilitating the securing of the hub 46 to the outer arm portion 56 of the pad holder. The outer arm portion 56 comprises a circular inner section 59 and the four arms 68, and is molded directly onto the mounting flange 52 and through holes 54 to form one unitary piece. Portions of the outer portion 56 extend through the holes 56 for greater bonding.

The outer arm portion 56 is made of a rigid high molecular weight plastic, while the hub 46 is made from a semi-flexible plastic, such as polyethylene. The semi-flexible plastic allows the pad holder 30 to universally pivot in any direction with respect to the shaft 38. That enables the buffing pad 28 to float over uneven floor surfaces without disrupting the alignment of the drive pulley 36 and pulley 42.

The buffing pad 28 is about twenty inches across its maximum dimension and is made from rubberized, loosely-spun, polyester fibers. The pad 28 has a central circular portion 58, from which four equiangularly spaced arms 60 extend, forming an X-shaped pad. In the center of the pad, there is a hole 62 which is sized to fit over the flanged support 64 (see FIG. 7) on the pad holder 30. A layer of Velcro fabric hooks 65 is attached to the pad holder 30 for fastening the pad 28 to the pad holder 30. The Velcro fabric hooks firmly engage directly with the fibers of the pad in a manner similar to the conventional velcro loop material.

Figure 6:
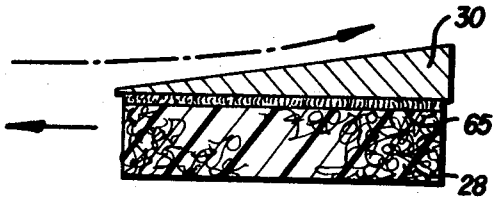
FIG. 6 is a side elevation, in cross-section, of one arm of the X-shaped pad holder and pad taken along line 6—6 of FIG. 5.
Figure 4:
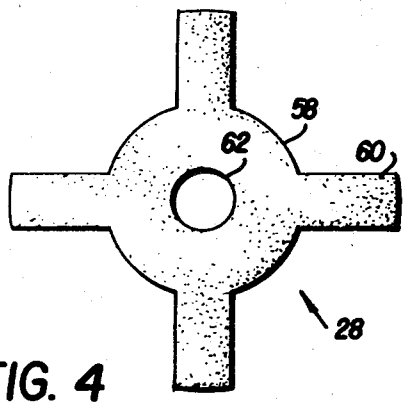
FIG. 4 is a top plan view of the X-shaped buffing pad.
Figure 5:
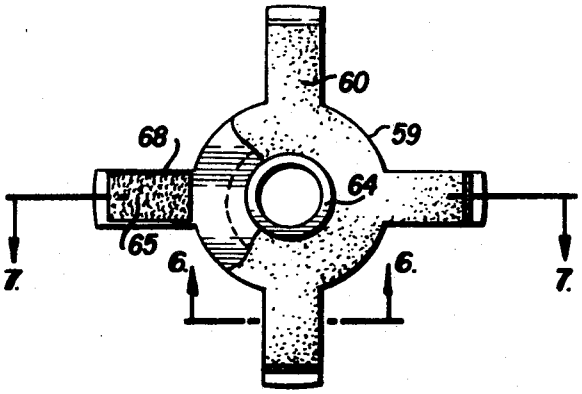
FIG. 5 is a bottom view of the X-shaped buffing pad holder and pad, partly broken away.

The pad holder 30 is slightly concave (see FIG. 7) to allow the ends of the pad arms 60 to firmly contact the floor surface. It is important that the ends of the pad are in firm contact with the floor, because it is the ends that determine the width of the buffed path. The arms 68 of the pad holder 30 are also wedge-shaped in cross-section in the manner of an air foil, as best seen in FIG. 6. The air foil shape causes air to be deflected upwardly through the openings between the arms of the pad and pad holder.

The pad casing 22 of the chassis comprises at its upper side a spiral diffuser 70, i.e., a half-round tunnel-like channel (see FIG. 1). A flexible skirt 72 is dependingly mounted at the lower edge of the pad casing 22 and extends around all but a small portion of the casing periphery. The skirt 72 prevents loose dust and dirt from being blown away from the buffing machine 10, while the spiral diffuser directs the air currents and loose debris in a spiral motion and into the motor housing 26 of the chassis 12.

A discharge collection box 74 is slidably mounted on tracks 75 within the motor housing 26. The collection box 74 is rectangular in shape and has an opening 76 on the front side thereof. When the box 74 is in place within the housing 26, the opening 76 is in alignment with an equally sized opening (not shown) in the motor housing 26 and with the adjacent large end of the spiral diffuser 70. Thus, in operation, air currents and loose dirt drawn upwardly by the air foil-like pad holder arms are guided through the spiral diffuser 70 and opening 76 into the discharge collection box 74. A handle 77 is connected to the side of the box opposite opening 76.

An air dispersal bag 78 is mounted within the collection box 74. The box 74 is made from expanded or perforated metal on the top and side surfaces. Thus, the air dispersal bag 78 disperses the air through the collection box 74, while retaining the dust and preventing it from being blown into the atmosphere.

The handle 18 for the buffing machine 10 is pivotably mounted, preferably to the wheel axle 15. Stops 82 are mounted on the motor housing 26 for limiting the pivoting motion of the handle 18. The handle arrangement allows the machine 10 to be pushed or pulled horizontally, but does not allow the operator to put additional pressure on the buffing pad by lifting up on the handle because the handle will simply pivot forward instead of transferring the pressure to the pad. The weight or pressure on the pad 28 is very important, in that too much weight on the pad will cause the motor to draw too much power, and too little weight will not allow the pad 28 to generate sufficient friction and heat to adequately buff the floor to a superior finish. The relative position of the motor 16 and the axle for the wheels 14 is designed to effect the proper weight distribution and load on the buffing pad. Therefore, it is important that the handle be designed such that the operator cannot easily alter the pressure on the pad.

The machine has two sets of wheels 13, 14, one located at the rear of the machine and the other located directly behind the buffing pad. When the machine is off, it is balanced so that the machine rests on all four wheels, and the buffing pad is raised above the floor and inclined at a slight angle a of about 6°–8°. See FIG. 9. When the machine is turned on, the vacuum effect created by the pad holder pulls the buffing pad onto the floor with a predetermined force, so that the pad applies the desired pressure on the floor surface. See FIG. 10. In that position, the weight of the machine is distributed between the buffing pad and the set of wheels located directly behind the pad. The rear wheels are raised above the floor.

Because the machine does not rest on the pad when not in use, the pad is less likely to become compressed during storage. In addition, when the machine is started the pad is not in contact with the floor so that there is a minimal load on the pad. Therefore, there is no initial power surge drawn by the motor when the machine is started.

The motor 16 is preferably a two horsepower motor wired for capacitive surge protection to reduce any surges or irregularities in its load requirements. With that motor, the buffing machine of the present invention using a twenty-inch X-shaped buffing pad is able to attain an average speed of about 2000 RPM, while drawing only about 15–18 amps of current under normal use, which current can be easily supplied by any household or commercial 110 volt wall outlet. At that speed, the X-shaped pad 28 is able to create enough friction and heat to melt the top layer of wax on the surface being buffed and provide a superior finish.

A conventional electric buffing machine, with a circular pad of comparable diameter, cannot operate satisfactorily at 2000 RPM with sufficient pressure to melt the floor wax with the power available from a standard 110 volt outlet. Because the pad 28 of the present invention is X-shaped, it has less surface area in contact with the floor than a circular pad of similar diameter. As a result of this reduced surface area, there is a net reduction in friction created by the rotation of the pad against the floor, allowing the X-shaped pad to be rotated at a greater speed than the conventional circular pad for a given amount of pressure on the floor by the pads. As explained above, the quality of the buff is dependent upon the speed of pad as well as the pressure exerted on the floor by the pad. Therefore, with less surface contact, the X-shaped pad is thus able to rotate at a faster speed with the same pressure and thus achieve a better surface finish.

Although the invention has been described in use with a buffing machine having a 110 volt electric motor, the invention is equally advantageous when applied to buffing machines powered by any means, such as a battery-powered motor, a 220 volt electric motor or a petroleum fueled motor.

Although only preferred embodiments are specifically illustrated and described herein, it will be appreciated that many modifications and variations of the present invention are possible in light of the above teachings and within the purview of the appended claims without departing from the spirit and intended scope of the invention.

What I claim is:

1. A buffing machine for buffing waxed floors and the like, comprising:

a chassis;

means mounted to the chassis for moving the chassis on a floor;

a motor mounted on said chassis;

a buffing pad holder drivably engaged to said motor; and an X-shaped buffing pad attached to said buffing pad holder, said buffing pad being formed of loosely spun polymeric fibers.

2. The buffing machine according to claim 1, further comprising a shaft rotatably mounted to said chassis, one end of said shaft being connected to said buffing pad holder, the other end of said shaft being operatively connected to said motor, and a pivot means interposed between said shaft and said buffing pad holder for pivoting said pad and pad holder in relation to said shaft over uneven floor surfaces.

3. The buffing machine according to claim 2, wherein said pivot means includes a flexible ring adjacent a hub means for receiving said shaft.

4. The buffing machine according to claim 3, wherein said pad holder comprises the hub means and an outer ring portion consisting of high molecular weight plastic that are integrally molded with the flexible ring to form a unitary element.

5. The buffing machine according to claim 4, wherein the buffing pad holder is concave.

6. The buffing machine according to claim 4, wherein the buffing pad holder is conical.

7. The buffing machine according to claim 1, wherein said buffing pad holder has X-shaped arms to correspond with the X-shape of the buffing pad, said arms having a wedge-shaped cross section for generating air currents.

8. The buffing machine according to claim 7, wherein said chassis comprises a casing having spiraling channel means protruding from the top surface thereof and extending adjacent the outer periphery thereof, one end of said channel means leading into a discharge opening in the casing.

9. The buffing machine according to claim 8, wherein said chassis comprises a motor housing having tracks therein, and a discharge collection box mounted in the housing on the tracks at the discharge opening for collecting dirt and loose debris.

10. The buffing machine according to claim 9, wherein said discharge collection box is perforated and has an air dispersal bag therein for receiving the dirt and loose debris.

11. The buffing machine according to claim 8, further comprising skirt means mounted to the lower edge of said chassis and extending around at least half of the casing periphery for controlling dust and air currents.

12. The buffing machine according to claim 7, wherein the wedge-shaped arms are arranged such that the generated air currents create a vacuum effect for collecting loose dirt.

13. The buffing machine according to claim 1, further comprising a handle pivotally connected to said chassis and stop means mounted on said chassis for limiting movement of the handle.

14. A buffing machine for buffing waxed floors and the like, comprising:

a chassis;

a set of wheels mounted on said chassis;

a spiraling tunnel-like channel protruding from the top surface of the chassis and extending adjacent the outer periphery thereof;

a motor mounted on said chassis;

a buffing pad holder drivably engaged to said motor, said holder having a top surface and a bottom surface with wedge-shaped air-foil means recessed within the holder between the top surface and the bottom surface for creating air currents directed upwardly into said channel; and a buffing pad attached to said pad holder.

15. A buffing machine for buffing waxed floors and the like, comprising:

a chassis;

a set of wheels mounted on said chassis;

a spiraling tunnel-like channel protruding from the top surface of the chassis and extending adjacent the outer periphery thereof;

a motor mounted on said chassis;

a buffing pad holder drivably engaged to said motor, said holder having wedged-shaped air-foil means for creating air currents directed upwardly into said channel; and a buffing pad attached to said pad holder, said buffing pad being X-shaped.

16. The buffing machine according to claim 15, further comprising a shaft rotatably mounted to said chassis, one end of said shaft being connected to said buffing pad holder, the other end of said shaft being operatively connected to said motor, and a pivot means interposed between said motor and said buffing pad holder to allow said pad and pad holder to pivot with respect to said motor over uneven floor surfaces.

17. The buffing machine according to claim 15, wherein said pivot means includes a flexible hub ring adjacent a means for receiving the shaft.

18. The buffing machine according to claim 15, further comprising a collection box arranged within said chassis such that air currents created by the rotation of said pad holder are directed through said channel and into the collection box.

19. A buffing pad for high speed floor buffing machines comprising a flat pad made of loosely-spun polymeric fibers, said pad having equiangularly spaced arms forming an X-shape.

20. The buffing pad according to claim 19, wherein the buffing pad is concave.

21. The buffing machine according to claim 20, wherein the buffing pad is conical.

22. A buffing machine for buffing waxed floors and the like, comprising:

a chassis;

front wheel means and rear wheel means mounted on said chassis in a first plane for supporting said chassis, the axis of said front wheel means being parallel to and spaced from the axis of said rear wheel means;

a motor mounted on said chassis;

a buffing pad holder drivably engaged to said motor, said pad holder being mounted in a second plane, the second plane being inclined with respect to the first plane; and a buffing pad mounted to the pad holder;

means for pivoting said buffing machine from a first position wherein the front and rear wheel means are in contact with the floor to a second position wherein the front wheel means and buffing pad are in contact with the floor and the rear wheel means is off the floor;

said pivoting means comprising means on the buffing pad holder for creating air currents which urge the buffing machine from said first position to said second position.

23. The buffing machine according to claim 22, wherein said front wheel means comprises a pair of front wheels in coaxial alignment and said rear wheel means comprises a pair of rear wheels in coaxial alignment, the axes of said wheel pairs being in said first plane.

24. A buffing machine for buffing waxed floors and the like, comprising:

a chassis;

front wheel means and wheel means mounted on said chassis in a first plane for supporting said chassis, the axis of said front wheel means being parallel to and spaced from the axis of said rear wheel means;

a motor mounted on said chassis;

a buffing pad holder drivably engaged to said motor, said pad holder being mounted in a second plane, the second plane being inclined with respect to the first plane; and a buffing pad mounted to the pad holder, said buffing pad being X-shaped;

means for pivoting said buffing machine from a first position wherein the front and rear wheel means are in contact with the floor to a second position wherein the front wheel means and buffing pad are in contact with the floor and the rear wheel means is off the floor;

said pivoting means comprising means on the buffing pad holder for creating air currents.

25. The buffing machine according to claim 22, further comprising a spiraling tunnel-like channel, protruding from the top surface of the chassis and extending adjacent the outer periphery thereof.

* * * * *

UNITED STATES PATENT AND TRADEMARK OFFICE

CERTIFICATE OF CORRECTION

PATENT NO. : 4,598,440

DATED : July 8, 1986

INVENTOR(S) : WILLIAM H. WILSON

It is certified that error appears in the above-identified patent and that said Letters Patent is hereby corrected as shown below:

Claim 24, column 8, line 46, insert --rear-- after "and".

Signed and Sealed this

*Sixteenth* Day of *September 1986*

[SEAL]

*Attest:*

DONALD J. QUIGG

*Attesting Officer*

*Commissioner of Patents and Trademarks*